US006371421B1

(12) United States Patent
Ma et al.

(10) Patent No.: US 6,371,421 B1
(45) Date of Patent: Apr. 16, 2002

(54) DEVICE FOR CONTROLLING THE HEIGHT OF A SWIVEL CHAIR

(75) Inventors: Dong Kwan Ma, Seoul; Young Ki Yoon, Pucheon-shi, both of (KR)

(73) Assignee: Samhongsa Co., Ltd., Seoul (KR)

( * ) Notice: Subject to any disclaimer, the term of this patent is extended or adjusted under 35 U.S.C. 154(b) by 0 days.

(21) Appl. No.: 09/129,093

(22) Filed: Aug. 5, 1998

(30) Foreign Application Priority Data

Aug. 23, 1997 (KR) ..... 97-22902
Nov. 17, 1997 (KR) ..... 97-32398

(51) Int. Cl.[7] ..... F16M 11/00
(52) U.S. Cl. ..... 248/161; 248/622; 384/609; 384/620; 188/300; D8/399
(58) Field of Search ..... 248/161, 157, 248/562, 566, 568, 569, 580, 599, 602, 609, 622, 631, 636; 411/531, 313, 371.2, 314, 324, 533; 384/420, 613, 609, 615, 617, 620; D8/399; 188/300

(56) References Cited

U.S. PATENT DOCUMENTS 430,648 A * 6/1890 Hildreth ..... 241/87.1
D32,360 S * 3/1900 Pierce ..... D8/399
3,847,456 A * 11/1974 Schwarzbich ..... 384/620
4,241,815 A * 12/1980 Federspiel ..... 188/282.5
4,245,826 A * 1/1981 Wirges ..... 267/131
4,720,068 A * 1/1988 Tornero ..... 248/161
4,899,969 A * 2/1990 Bauer et al. ..... 248/161
5,074,681 A * 12/1991 Turner et al. ..... 384/613
5,120,011 A * 6/1992 Mintgen et al. ..... 248/162.1
5,269,398 A * 12/1993 Wolf et al. ..... 188/300
5,413,414 A * 5/1995 Bauer ..... 384/276
5,462,248 A * 10/1995 Bauer ..... 248/161
5,556,170 A * 9/1996 Lai et al. ..... 297/463.1
5,702,083 A * 12/1997 Lai ..... 248/404
5,749,557 A * 5/1998 Chang ..... 248/405
6,079,690 A * 6/2000 Yoon ..... 248/622

* cited by examiner

*Primary Examiner*—Anita King
(74) *Attorney, Agent, or Firm*—Birch, Stewart, Kolasch & Birch, LLP

(57) ABSTRACT

The present invention relates to a height-controlling device of a swivel chair. An objective of this invention is to prevent the detachment of components which are fitted to the end of a piston rod of a cylinder, resulting in the improvement of work conditions.

The height-controlling device of the present invention is comprised of an elastic body 620, bearing supports 42 and 44, and a ball bearing 50 which are fitted to the end of a piston rod 610 of a cylinder 12; and a retaining washer 1 which is fixed to the piston rod and prevents the detachment of the elastic body, the bearing supports and the ball bearing component from the piston rod.

Alternatively, the height-controlling device of the present invention is comprised of an elastic body 620 and a bearing support 42 which are fitted to the end of a piston rod 610 of a cylinder 12; and a thrust bearing 500 which is fixed to the piston rod and functions as both the bearing support 44 and the ball bearing component 50. In order to prevent the detachment of the elastic body, the bearing support and the thrust bearing, the thrust bearing 500 includes extending portions 7 on the inner circumference thereof. The thrust bearing is fixed to the piston rod by the extending portions.

23 Claims, 8 Drawing Sheets

DEVICE FOR CONTROLLING THE HEIGHT OF A SWIVEL CHAIR

BACKGROUND OF THE INVENTION

1. Field of the Invention

The present invention relates to a device controlling the height of a swivel chair which is placed between the seat and the legs of the chair. The present invention more particularly relates to keeping components in place after inserting the components into a piston rod of a cylinder of the device, improving working conditions, and accommodating the operation and rotation of the chair.

2. Description of the Related Art

One example of a device controlling the height of a conventional swivel chair is shown in FIG. 1, an exploded view, and FIG. 2, a cross-sectional view.

A cylinder guide 602 is inserted into a hollow cylindrical outer case 600, and a cylinder 12 is inserted into the cylinder guide 602.

An elastic component 620 is fitted to the end of a piston rod 610 which is placed at the bottom of the cylinder 12. The elastic component 620 absorbs shocks given to the cylinder 12 as the piston rod 610 moves up and down in relation to the cylinder 12. Bearing supports 42 and 44, and a ball bearing component 50 are placed on the end of the piston rod 610.

The bearing supports 42 and 44, and the ball bearing component 50 do not move upward from the end of the piston rod 610 due to a swollen portion 35 which is formed at the piston rod.

A ball bearing 52 is inserted into the ball bearing component 50, and the ball bearing component 50 is sandwiched between the bearing supports 42 and 44 to allow the cylinder 12 to rotate even though weight is applied to the ball bearing component 50 through the body 605 of the cylinder and the elastic body 620.

The bottom of the piston rod 610, which is inserted into the elastic body 602, the ball bearing component 50 and the bearing supports 42 and 44 is placed on a fixer 100 which is extended from the bottom of the outer case 600. The piston rod 610 is fixed to the outer surface of the fixer 100 by inserting a clip 230 into a hole 250 formed in the end of the piston rod 610.

The fixer 100 and the outer case 600 are formed in one body, and the piston rod 610 is fixed to the fixer 100 so that the body 605 of the cylinder 12 can move up and down in the cylinder guide 602 by using a gas or an oil pressure in the cylinder.

The hollow cylindrical outer case is fixed to the base of the chair, and the top of the cylinder 12 is fixed to the seat of the chair so that it is possible to rotate the chair and to control the height of the chair.

The device controlling the height of the conventional swivel chair is already well known to those skilled in this art. The inner structure of the cylinder 12 is described below.

A wall 604 is in contact with the inner surface of the body 605 of the cylinder. An airtight hull/component 606 which includes rings 607 is placed on the top of the wall 604 in order to contain a fluid substance 700 in the chamber of the cylinder without leakage. A piston 608 which moves up and down via the fluid substance 700 is placed at the bottom of the wall 604, and the piston rod 610 is attached to the piston 608.

A button 33 is placed on the top of the airtight hull 606, which is connected with a cock 88 through which the fluid substance 700 enters and exits. Preferably, the cock is formed in the airtight hull 606.

The height-controlling device of the conventional swivel chair described above has the following problem. The components, i.e. the bearing support and the ball bearing component, are easily detached when the piston rod 610 of the cylinder 12 is fixed to the fixer 100 of the outer case 600, resulting in the increase in the manufacturing time.

In order to fix the piston rod 610 of the cylinder 12 to the fixer 100, first, the end of the piston rod 610 is inserted through the elastic body 620, the bearing supports 42 and 44, and the ball bearing component 50, and the cylinder 12 including the piston rod 610 is inserted through the cylinder guide 602 which is inserted into the outer case 600 until the hole 250 which is formed at the end of the piston rod 610 emerges through the fixer 100. The bearing supports 42 and 44, and the ball bearing component are loosely fitted onto the piston rod 610. Therefore, if the piston rod is inserted carelessly, the bearing supports and the ball bearing are detached easily.

In addition, the manufacturing time is increased because the piston rod must be fixed to the fixer slowly and carefully in order to prevent the detachment of the bearing supports and the ball bearing component.

Furthermore, the outer case 600 and the cylinder 12 can be stored separately. When they are stored separately, the bearing supports 42 and 44, and the ball bearing component 50 must also be stored separately with care in order to prevent their loss. This results in added inconvenience.

SUMMARY OF THE INVENTION

An objective of the present invention is to eliminate the problems mentioned above, i.e. to prevent the detachment of the elastic body 620, the bearing supports 42 and 44, and the ball bearing component 50.

Another objective of the present invention is to improve work conditions by preventing the detachment of the elastic body 620, the bearing supports 42 and 44, and the ball bearing component 50.

A height-controlling device of a swivel chair according to the present invention is comprised of an elastic body, bearing supports and a ball bearing component which are fitted to the end of a piston rod of a cylinder; and a retaining washer which keeps the elastic body, the bearing supports and the ball bearing in place. The cylinder is inserted into a hollow cylindrical outer case which encloses a cylinder guide. The retaining washer is placed on the inner surface of a fixer of the outer case. The end of the piston rod which emerges from the outer case is fixed on the outer surface of the fixer.

Another height-controlling device of a swivel chair of the present invention is comprised of an elastic body, a bearing support and a thrust bearing which are fitted to the end of a piston rod of a cylinder. In order to prevent detachment of the elastic body, the bearing support and the thrust bearing, the thrust bearing is tightly fitted to the piston rod. The cylinder is inserted into a hollow cylindrical outer case which encloses a cylinder guide. The thrust bearing is placed on the inner surface of a fixer of the outer case, and the end of the piston rod which emerges from the outer case is fixed on the outer surface of the fixer.

DETAILED DESCRIPTION OF THE PREFERRED EMBODIMENTS

Figure 1:
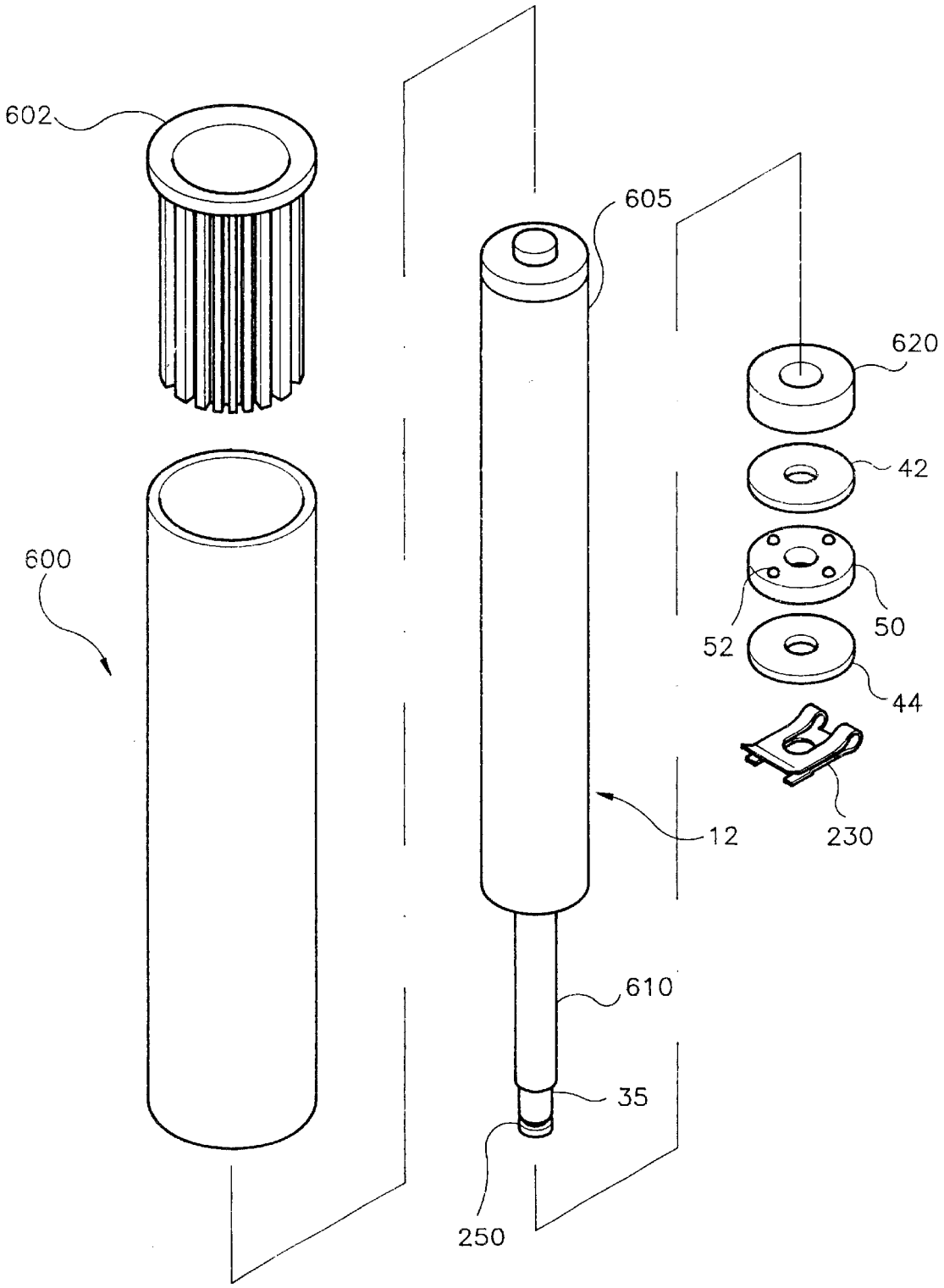
Fig. 1 Conventional Art
FIG. 1 is an exploded view showing a height-controlling device of a conventional swivel chair.
Figure 2:
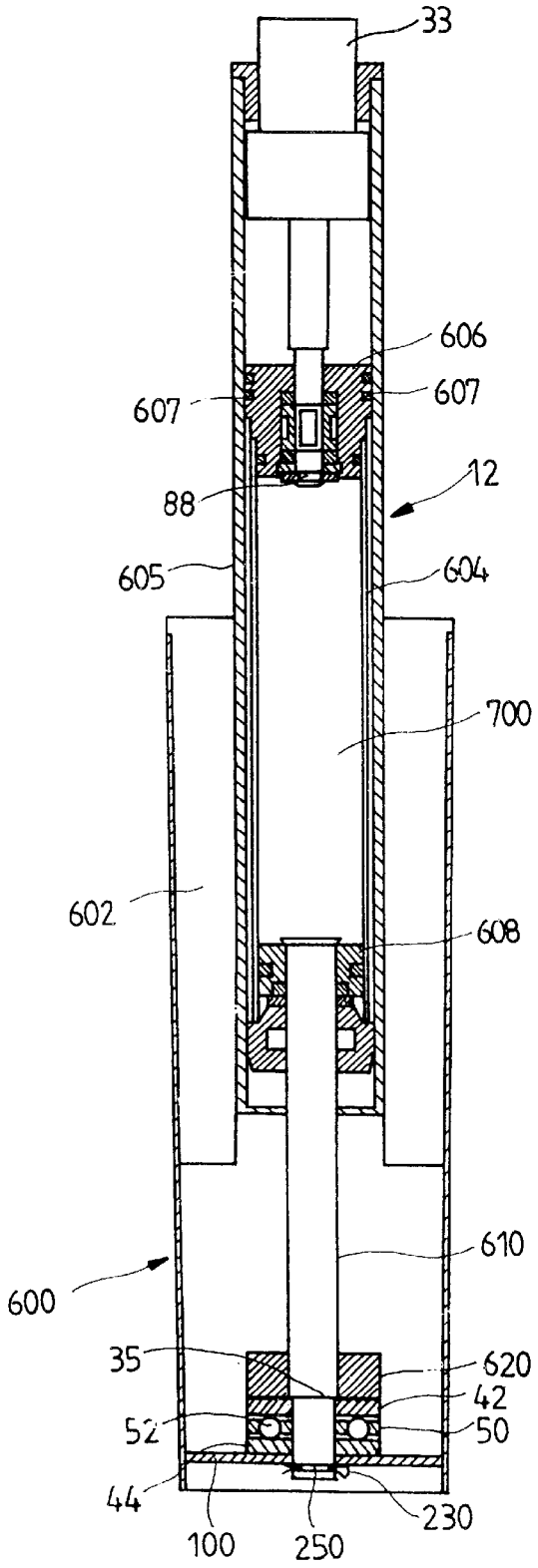
Fig. 2 Conventional Art
FIG. 2 is a cross-sectional view showing the height-controlling device of the conventional swivel chair.
Figure 3:
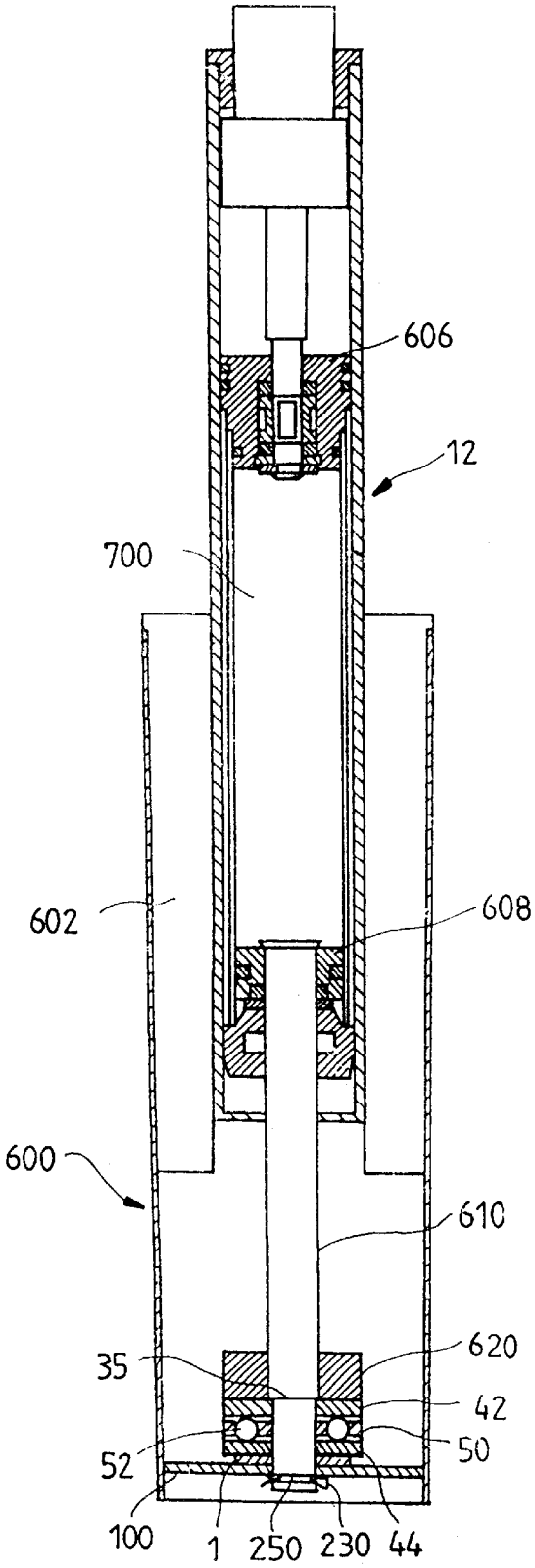
FIGS. 3, 6 and 9 are cross-sectional views showing various height-controlling devices of the present invention.

Various embodiments of the present invention will be described below. Components which are used in the conventional art are depicted by the same reference number.

First Preferred Embodiment

The description of this embodiment is made in detail with reference to FIGS. 3, 4*a* to 4*d*, and 5, which show a cross-sectional view of the height-controlling device, various retaining washers, and a three-dimensional view of a piston rod, respectively.

The structure of the height-controlling device of this embodiment is similar to that of the above-described device of the conventional swivel chair. Therefore, the description is focused on the end of the piston rod 610 of the cylinder 12.

The piston rod 610 includes a swollen portion 35 at the bottom thereof in order to prevent the bearing supports 42 and 44, and the ball bearing component 50 from moving upward, and to prevent the piston rod from being pushed through the bottom of the outer case 600.

When weight is applied to the cylinder 12, it affects the bearing supports and the ball bearing component through the swollen portion 35 of the piston rod 610, and the bearing supports and the ball bearing component are blocked by the fixer 100 of the outer case 600.

Therefore, as mentioned above, the piston rod 610 cannot be pushed out through the bottom of the outer case 600 even though a pressure/weight is applied to the cylinder 12.

A hole 250 is formed in a portion of the piston rod 610 which emerges from the fixer 100, and a clip 230 is placed through the hole 250.

As described above, the piston rod 610 is fixed to the fixer 100 of the outer case 600 so that the height of the cylinder 12 can be controlled in relation to the fixer 100.

Preferably, an elastic body 620 is fitted to the top of the swollen portion 35 of the piston rod 610 in order to absorb shocks which are given to the cylinder 12.

A retaining washer 1 is fixed under the bearing support 44 in order to prevent the detachment of the bearing supports 42 and 44 and the ball bearing component 50 which are fitted under the swollen portion 35.

In order to fix the retaining washer 1 easily, protruding ring-like portions 39 are formed around the circumference of a portion of the piston rod which is beneath the swollen portion 35.

By fixing the retaining washer 1 at the end of the piston rod 610, the processes of inserting the cylinder 12 and the piston rod 610 into the outer case 600, and of fixing the piston rod 610 to the fixer 100 can be accomplished with ease. As a result, the manufacturing time can be reduced.

In other words, the problem of detachment of the bearing supports and the ball bearing component can be obviated.

Furthermore, when the cylinder and the outer case are separately stored, the problem of losing the bearing supports 42 and 44, and the ball bearing component 50 can be obviated by fitting the elastic body 620, the bearing supports 42 and 44, and the ball bearing 50 component to the piston rod and by fixing them using the retaining washer 1.

The retaining washer 1 has extensions (washer extensions) 2 which extend from the inner surface of the retaining washer and are spaced equally apart from each other. The washer extensions 2 are fixed between the neighboring ring-like protruding portions 39 of the piston rod 610 when the retaining washer 1 is placed onto the piston rod 610.

The retaining washer 1 is formed in accordance with the weight of the piston rod. Preferably, the retaining washer 1 has an outside diameter of 10 mm–30 mm, an inside diameter of 4–20 mm, and a thickness of 0.2 mm–1 mm. The retaining washer is made of metal or synthetic resins.

The washer extension 2 has a width of 1 mm–5 mm, and is of a circle, a square, a polygon, or a semicircle.

Figure 4A:
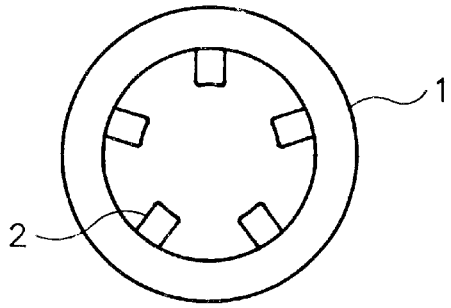
FIGS. 4*a* to 4*d* show a retaining washer of the present invention.
Figure 4B:
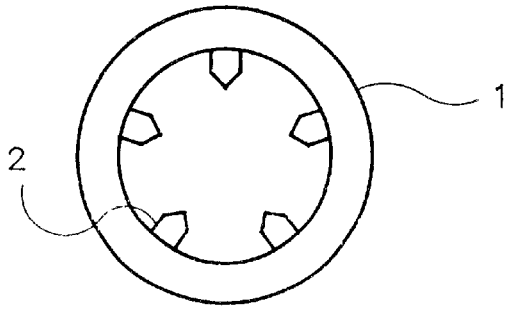
Figure 4C:
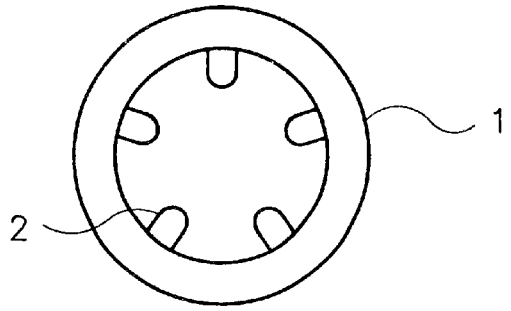
Figure 4D:
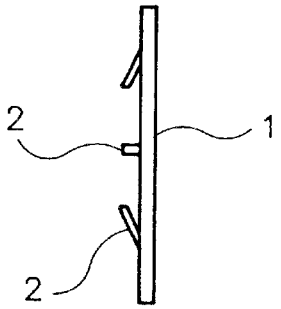
Figure 5:
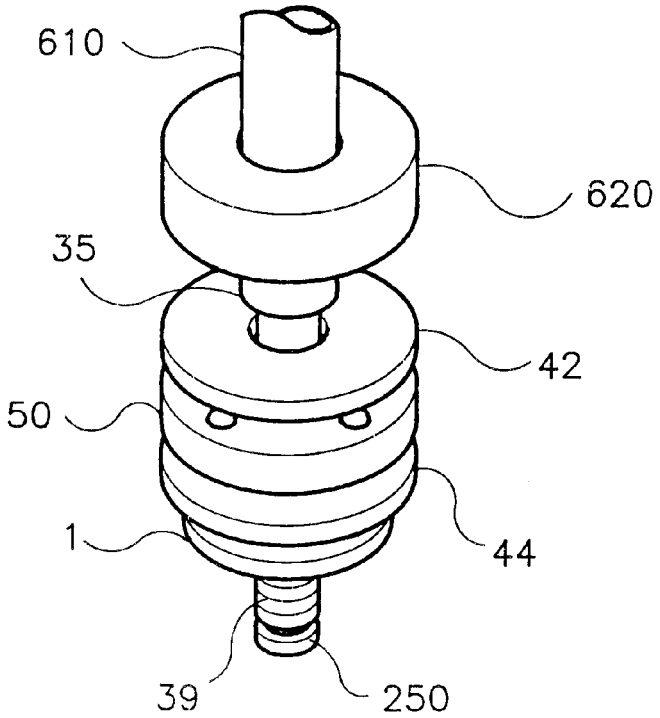
FIGS. 5 and 7 are enlarged three-dimensional views showing a piston rod of the present invention.
Figure 7:
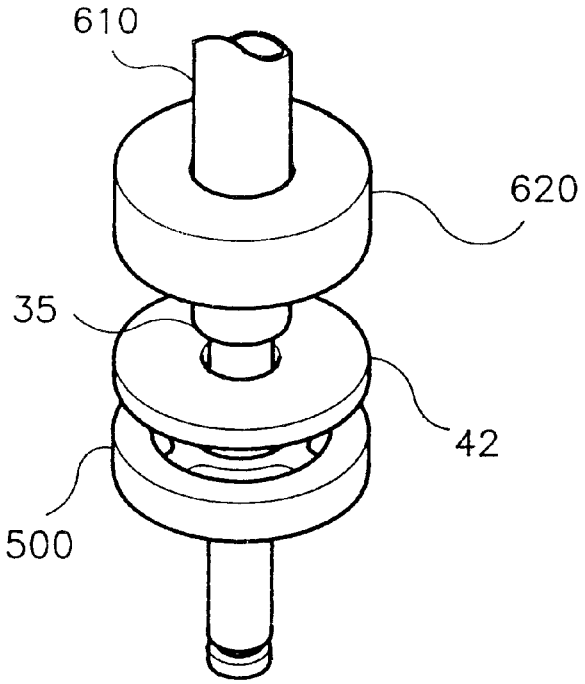
Figure 6:
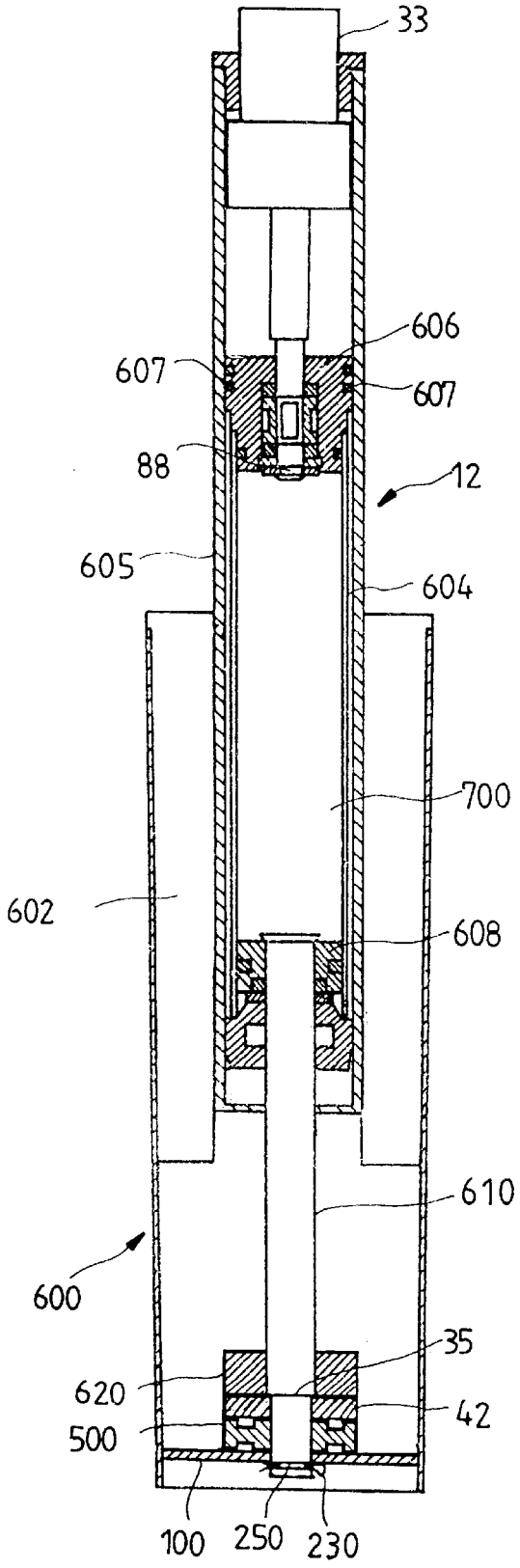

As shown in FIG. 4*d*, a lateral view of the retaining washer, each washer extension 2 slopes down.

Second Preferred Embodiment

Figure 8A:
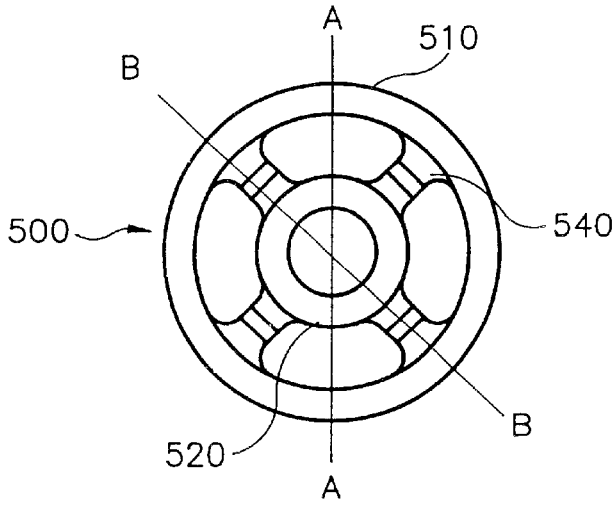
FIG. 8*a* is a plane view showing a thrust bearing of the present invention.
Figure 8B:
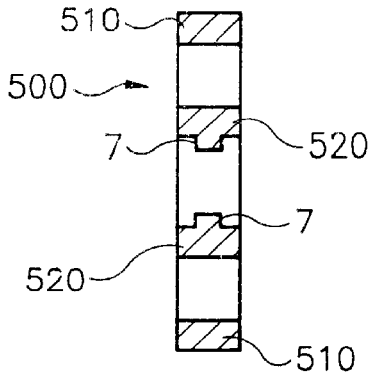
FIGS. 8*b*, and 8*c* are cross-sectional views of FIG. 8*a*.
Figure 8C:
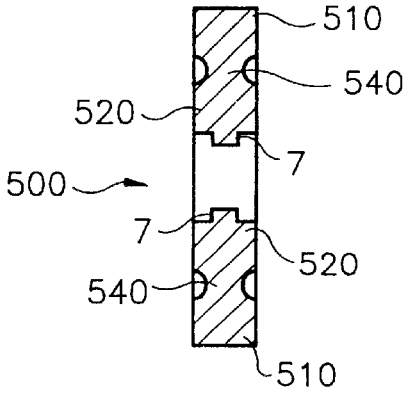

The description of this embodiment is made in detail with reference to FIGS. 6, 7, 8*a*, 8*b* and 8*c*, which show a cross-sectional view of the height-controlling device, an enlarged three-dimensional view of the end of the piston rod, a plane view of a thrust bearing, a cross-sectional view taken along line A—A of FIG. 8*a*, and a cross-sectional view taken along line B—B of FIG. 8*a*, respectively.

According to this embodiment of the present invention, the problem of components, which are fitted to the end of the piston rod 610, becoming detached can be obviated. Furthermore, the number of components is reduced.

An elastic body 620, a bearing support 42 and a thrust bearing 500 are fitted to the end of the piston rod 610.

The thrust bearing 500 functions as both the bearing support 44 and the ball bearing component 50 which are used in the first preferred embodiment. The thrust bearing 500 is tightly fitted to the piston rod 610 so that it rarely detaches from the piston rod unless a certain pressure is applied.

The thrust bearing is comprised of a circular outer body 510, a circular inner body 520, a connector 540 which connects the outer body with the inner body, and extending portions 7. The extending portions 7 adhere closely to the piston rod 610. Because the extending portions of the thrust bearing adhere closely to the piston rod 610 for preventing the detachment, the piston rod is easily worn away. In order to prevent this, the thrust bearing is preferably made of materials which have a lower hardness than the piston rod, such as hard synthetic resins, teflon, and FRP (fiber reinforced plastics).

The thrust bearing 500 which is sandwiched between the bearing support 42 and the fixer 100 is formed by combining the circular outer body 510 and the circular inner body 520 using the connector 540 so that the friction surface is reduced, and a space for injecting grease is created. The connector 540 preferably connects the circular outer body with the circular inner body at the middle portions, and has a smaller height than the outer and inner bodies so as to reduce the friction surface and to provide for the injection of grease.

The above described thrust bearing 500 helps to insert the cylinder 12 and the piston rod 610 into the outer body 600 with ease, and to reduce the manufacturing time.

Even when the cylinder is stored without fixing it to the fixer of the outer case, the elastic body 620, the bearing support 42 and the thrust bearing 500 rarely detach from the piston rod due to the tight fit of the thrust bearing 500 on the piston rod 610. As a result, the problem of missing components which are fitted to the end of the piston rod 610 can be obviated, and the number of components is reduced.

Third Preferred Embodiment

Figure 9:
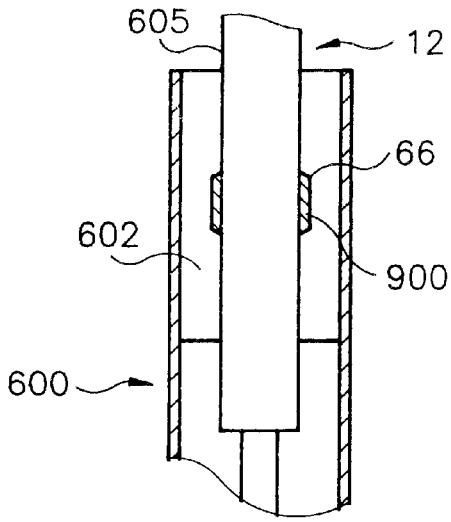
Figure 10A:
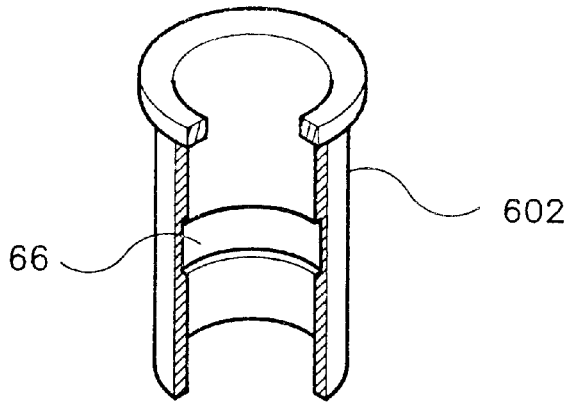
FIGS. 10*a* and 10*b* are three-dimensional views of a cylinder guide of the present invention.
Figure 10B:
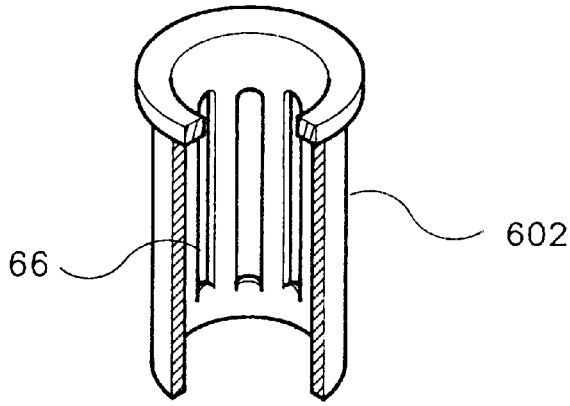

The description of this embodiment is made in detail with reference to FIGS. 9, 10*a* and 10*b*, which show a cross-sectional view of the height-controlling device and a three-dimensional view of a cylinder guide, respectively.

The height-controlling device of this embodiment has the same structure described in the first or the second embodiment. The cylinder guide 602 which is inserted into the outer case 600 includes grooves 66. Grease 900 is injected through the grooves 66 so that the friction between the cylinder guide 602 and the body 605 of the cylinder 12 can be reduced.

The grooves 66 are formed around the inner circumference of the cylinder guide 602. Alternatively, the grooves 66 can be formed along the length-axis.

By forming the grooves, through which the grease is injected, on the inner surface of the cylinder guide 602, the friction occurring as the cylinder moves up and down is minimized.

ADVANTAGES OF THE PRESENT INVENTION

As described above, the process of fixing the cylinder 12 with the outer case 12 can be accomplished with ease because the components which are fitted to the end of the piston rod rarely become detached by using the retaining washer and the thrusting bearing, resulting in the reduction of the manufacturing time.

Furthermore, even when the cylinder is stored without having been fixed to the outer case, the cylinder can be stored with the bearing supports, the ball bearing, and the retaining washer (as described in the first embodiment), or with the thrust bearing (as described in the second embodiment) fitted to the end of the piston rod of the cylinder. As a result, the problems of damage and loss of the components can be obviated.

What is claimed is:

1. A height-controlling device of a swivel chair comprising:

an elastic body, bearing supports and a ball bearing component which are fitted to the end of a piston rod of a cylinder, said piston rod having annular ring-like projections on said end; and a retaining washer having a plurality of extensions which protrude radially inwardly from the inner surface of the said washer in engaging relationship with said annular ring-like projections on said end of said piston rod;

whereby said retaining washer maintains said elastic body, bearing supports and ball bearing component in position on said piston rod.

2. A height-controlling device of a swivel chair according to claim 1, wherein the cylinder is inserted into a hollow cylindrical outer casing which encloses a cylinder guide;

wherein the retaining washer contacts a surface of a retaining element which is formed at the bottom of the outer casing; and wherein the end of the piston rod passes through the retaining element, and the piston rod is fixed on the outer surface of the retaining element.

3. A height-controlling device of a swivel chair according to claim 2, wherein the cylinder guide includes at least one groove which is formed on the inner surface of the cylinder guide, and grease is injected through the groove to reduce friction between the cylinder guide and the cylinder as the cylinder rotates or moves up and down.

4. A height-controlling device of a swivel chair according to claim 3, wherein the groove is formed along a length-axis of the cylinder guide.

5. A height-controlling device of a swivel chair according to claim 1, wherein the outside diameter of the retaining washer is 10 mm to 30 mm.

6. A height-controlling device of a swivel chair according to claim 1, wherein the inside diameter of the retaining washer is 4 mm to 20 mm.

7. A height-controlling device of a swivel chair according to claim 1, wherein the width of each of said extensions of the retaining washer is 1 mm to 5 mm.

8. A height-controlling device of a swivel chair according to claim 1, wherein each extension of the retaining washer has a circular, square, polygonal or semicircular configuration.

9. A height-controlling device of a swivel chair according to claim 1, wherein the thickness of the retaining washer is 0.2 mm to 1 mm.

10. A height-controlling device of a swivel chair according to claim 1, wherein said extensions of the retaining washer extend downwardly.

11. A height-controlling device of a swivel chair according to claim 1, wherein the retaining washer is made of one of metal or synthetic resins.

12. A height-controlling device of a swivel chair according to claim 1, wherein said annular ring-like projections on said piston rod are spaced equally apart.

13. A height-controlling device of a swivel chair comprising:

an elastic body, a bearing support, and a thrust bearing which are fitted to the end of a piston rod of a cylinder;

wherein the inner circumference of the thrust bearing is tightly fitted to the piston rod, and wherein the thrust bearing includes a cylindrical outer body, a cylindrical inner body, at least two connectors which connect the outer body and the inner body, and extending portions which are formed on the inner circumference of the inner body and are fixed to the piston rod.

14. A height-controlling device of a swivel-chair according to claim 13, wherein the cylinder is inserted into a hollow cylindrical outer casing which encloses a cylinder guide;

wherein the thrust bearing contacts the inner surface of a retaining element which is formed at the bottom of the outer casing; and wherein the end of the piston rod passes through the retaining element, and the piston rod is fixed on the outer surface of the retaining element.

15. A height-controlling device of a swivel chair according to claim 14, wherein the thrust bearing includes a cylindrical outer body, a cylindrical inner body, at least two connectors which connect the outer body and the inner body, and extending portions which are formed on the inner circumference of the inner body and are fixed to the piston rod.

16. A height-controlling device of a swivel chair according to claim 15, wherein the height of each connector is smaller than that of the outer body and that of the inner body.

17. A height-controlling device of a swivel chair according to claim 16, wherein the connectors of the thrust bearing have grooves on the top and the bottom.

18. A height-controlling device of a swivel chair according to claim 15, wherein the thrust bearing is comprised a material selected from the group consisting of hard synthetic resins and fiber reinforced plastics.

19. A height-controlling device of a swivel chair according to claim 14, wherein the cylinder guide includes at least one groove which is formed on the inner surface of the cylinder guide, and wherein grease is injected through the groove to reduce friction between the cylinder guide and the cylinder as the cylinder rotates or moves up and down.

20. A height-controlling device of a swivel chair according to claim 19, wherein the groove is formed along the length-axis of the cylinder guide.

21. A height-controlling device of a swivel chair according to claim 13, wherein the height of each connector is smaller than that of the outer body and that of the inner body.

22. A height-controlling device of a swivel chair according to claim 21, wherein the connectors of the thrust bearing have grooves on the top and the bottom.

23. A height-controlling device of a swivel chair according to claim 13, wherein the thrust bearing is comprised a material selected from the group consisting of hard synthetic resins and fiber reinforced plastics.

* * * * *